US008710386B2

(12) United States Patent
Tavilla et al.

(10) Patent No.: US 8,710,386 B2
(45) Date of Patent: Apr. 29, 2014

(54) FLUID PRESSURE RESPONSIVE ELECTRIC SWITCH

(75) Inventors: Peter J. Tavilla, Attleboro, MA (US); Richard T. Gordon, Middleboro, MA (US); Adam M. Haag, Saltsburg, PA (US); Bryan J. Dague, Norton, MA (US)

(73) Assignee: Sensata Technologies, Inc., Attleboro, MA (US)

( * ) Notice: Subject to any disclaimer, the term of this patent is extended or adjusted under 35 U.S.C. 154(b) by 246 days.

(21) Appl. No.: 13/280,521

(22) Filed: Oct. 25, 2011

(65) Prior Publication Data

US 2012/0199465 A1 Aug. 9, 2012

Related U.S. Application Data

(60) Provisional application No. 61/439,539, filed on Feb. 4, 2011.

(51) Int. Cl.
*H01H 35/34* (2006.01)

(52) U.S. Cl.
USPC ..... 200/83 P

(58) Field of Classification Search
USPC ..... 200/83 P, 61.25, 61.86, 235, 81 R, 200/81.9 R, 83 R, 83 Y, 83 W, 195
See application file for complete search history.

(56) References Cited

U.S. PATENT DOCUMENTS

| | | | | |
|---|---|---|---|---|
| 3,140,369 | A | | 7/1964 | Pannell |
| 4,172,971 | A | * | 10/1979 | Silverwater et al. ..... 200/82 E |
| 4,297,552 | A | * | 10/1981 | Lauritsen et al. ..... 200/83 P |
| 5,021,618 | A | * | 6/1991 | Ubukata et al. ..... 200/61.47 |
| 5,123,332 | A | * | 6/1992 | Thayer et al. ..... 92/103 M |
| 5,808,255 | A | | 9/1998 | Sehlhorst et al. |
| 5,917,164 | A | * | 6/1999 | Sasaki ..... 200/83 P |
| 5,932,857 | A | * | 8/1999 | Stander et al. ..... 200/83 B |

OTHER PUBLICATIONS

European Search Report dated Jun. 6, 2012 in corresponding European Patent Application No. 12152435.9.

* cited by examiner

*Primary Examiner* — Edwin A. Leon
*Assistant Examiner* — Anthony R. Jimenez
(74) *Attorney, Agent, or Firm* — Chapin IP Law

(57) ABSTRACT

A pressure responsive electric switch is described having an elongated base containing an electrical switch and terminals. The base is attached to a sensor assembly which actuates and de-actuates the electric switch in response to pressure to be measured. The sensor assembly has a composite actuator member comprising a plurality of stacked snap-acting disc members which includes at least one snap-acting disc member of a chosen low coefficient of thermal expansion and at least one snap-acting disc member of chosen high coefficient of thermal expansion material so as to provide precise pressure activation/deactivation points over a wide temperature range. In a second embodiment, the composite actuator member includes a thermal adjustment member.

16 Claims, 4 Drawing Sheets

DETAIL B

DETAIL B

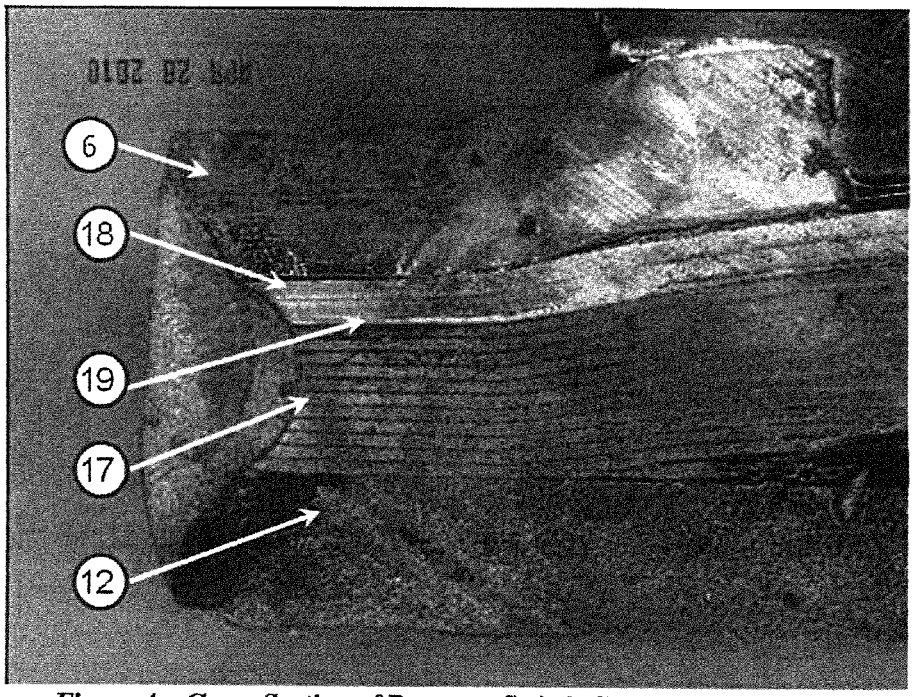
Figure 4 – Cross Section of Pressure Switch Composite Disk Stack
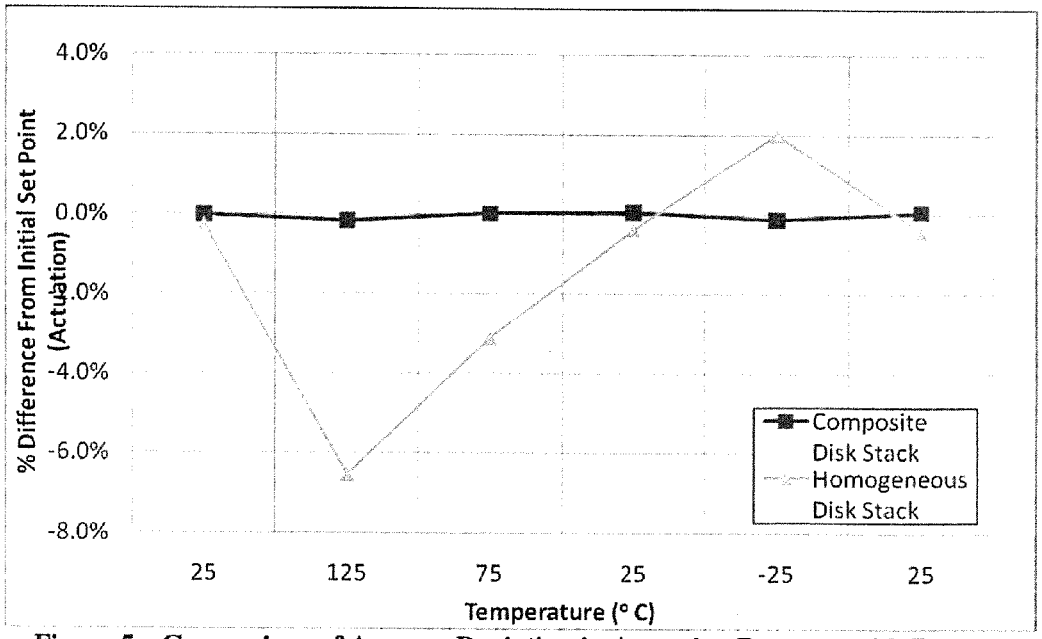
Figure 5 – Comparison of Average Deviation in Actuation Pressure with Respect Temperature for Composite & Homogeneous Pressure Switch Devices

DETAIL B

FLUID PRESSURE RESPONSIVE ELECTRIC SWITCH

FIELD OF THE INVENTION

This invention relates generally to fluid pressure responsive electric switches, and more particularly to certain specific features for making such switches more accurate in pressure measurements over a wide temperature operating range.

BACKGROUND OF THE INVENTION

Devices for opening and closing an electric circuit in response to changes in values of fluid pressure by admitting the fluid pressure to one side of a rapid deflection actuator, such as a snap acting diaphragm, causing it to move from a first configuration to a second configuration at a predetermined actuation pressure value and return at another deactuation pressure value are well known. Typically, a motion transfer member is movably mounted adjacent the actuator and adapted to transfer motion from the actuator to a movable arm of an electric switch.

In HVAC and industrial applications where high pressure "cutouts" for compressors are encountered (elevated temperatures and pressures on the order of 2000 psig and 125° C.), there is a need for a switch that is both robust and stable throughout the range of pressures and temperatures seen in operation for a given working fluid. Pressure switching actuators for high pressure applications to-date have been made utilizing homogeneous layers of nested disc stacks for the actuator member. These devices have, however, suffered from significant change in the pressure switch points over the temperature range of −25° C. to 125° C. seen in operation. The shift in switch pressure points with temperature can lead to early or late cutout of the compressor/system in which the switch is incorporated. There is a need for more precise mechanical switches which maintain constant switch points over a wide range of temperatures while measuring high pressure of fluids.

SUMMARY OF THE INVENTION

It is an object of the present invention to provide a fluid pressure responsive electric switch for high pressure cutout applications in HVAC, industrial and other applications which provides precise pressure set points over a wide temperature range. More specifically, it is an object to provide such a switch which maintains pressure switch points at temperatures ranging from −25° C. to 125° C. within 1% or less of their room temperature values.

Briefly, in accordance with a preferred embodiment of the invention, a fluid pressure responsive electric switch comprises an elongated generally tubular base member having a longitudinal axis and having a sidewall extending between a first and a second end;

a motion transfer guide member having a central bore mounted at the first end of the base member;

a fluid pressure responsive sensor assembly, said sensor assembly comprising a composite actuator member sandwiched between a disc housing member with a central aperture and a housing support member with a central aperture, the disc housing member, housing support member and the composite actuator member all having outer circular peripheral portions being welded together and being generally in alignment with the guide member, the sensor assembly and the base member being joined together; and an electric switch disposed within the base member and a motion transfer pin slidably mounted in the guide member and extending through the aperture in the housing support between the composite actuator member and the electric switch, said composite actuator member comprising at least one member of a chosen low coefficient of thermal expansion (CTE) material and at least one member of a chosen high CTE material.

In accordance with another preferred embodiment of this invention, the fluid pressure responsive electric switch has a composite actuator member comprising at least one snap-acting disc member of a chosen low CTE material and at least one snap-acting disc member of a chosen high CTE material.

In accordance with another preferred embodiment of the invention, the pressure responsive electric switch has a composite actuator member comprising at least one snap-acting member of a chosen low CTE material and at least one snap-acting disc member of a chosen high CTE material and additionally, includes a membrane positioned between the at least one high CTE material disc member and the at least one low CTE material disc member.

In accordance with still another preferred embodiment of this invention, the composite actuator member includes additionally a thermal adjustment member of a chosen low CTE material.

BRIEF DESCRIPTION OF THE DRAWINGS

The details of the invention will be described in conjunction with the accompanying drawings in which:

FIG. 4 is a picture of a partial cross section view of the welded pressure sensor assembly of FIG. 3; and FIG. 5 is a graph showing Comparisons of Average Deviation in Actuation Pressure of the Composite Pressure Switch of the first embodiment of the present invention and a Homogeneous Pressure Switch of the prior art.

Similar reference characters indicate corresponding parts throughout the several views of the drawings.

DESCRIPTION OF THE PREFERRED EMBODIMENTS

Figure 1:
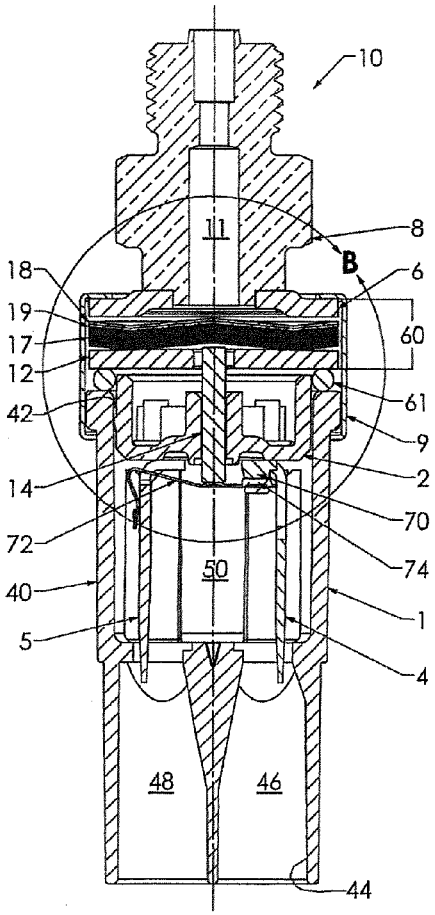
FIG. 1 is a cross sectional view of a fluid pressure responsive electric switch in accordance with the first embodiment of the present invention (weld not shown)
Figure 3:
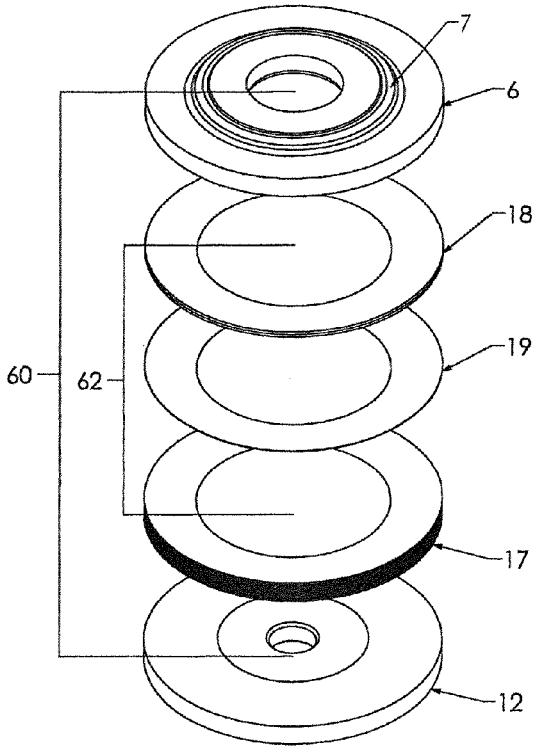
FIG. 3 is an exploded view of the pressure sensor assembly of the fluid pressure responsive switch of FIG. 1.

With reference to FIGS. 1-4, a fluid pressure responsive electric switch 10 made in accordance with a first embodiment of the invention comprises a generally elongated tubular base member 1 having a longitudinal axis being made of suitable electrically insulative material such as PBT (polybutyl-pleraphthalate). Base member 1 has a cylindrical wall 40 extending from a first open end 42 to a second open end 44. The second open end of base member 1 has first and second bores 46 and 48 extending parallel to each other into a central switch cavity 50 within base member 1. The central cavity contains an electric switch 13. A first and a second terminal member 4, 5 are secured in base member 1 with the first terminal member 4 extending from switch cavity 50 into first bore 46 and the second terminal member 5 extending from switch cavity 50 into second bore 48. The first terminal 4 is provided at one end within the switch cavity with a stationary contact 70 of the electric switch. The second terminal 5 is provided with an electrically conductive, movable spring contact arm 72 which is mounted on second terminal 5 at one end with a movable electrical contact 74 mounted at the other end of the movable spring contact arm (see FIG. 2). The movable and stationary contacts 74, 70 of the electric switch are positioned one relative to the other so as to be able to make and break contact with one another upon movement of movable spring contact arm 72.

A motion transfer guide member 2 having a central bore 80 for receiving a slidably moving transfer member 14 is mounted at the first open end 42 of base member 1 on top of terminals 4, 5. Guide member 2 has external cylindrical walls which slidingly fit within open end 42 of base member 1. A sensor assembly 60 (to be discussed in detail below) is positioned directly adjacent guide member 2 and is attached to base member 1 by a cylindrical cap member 9 preferably made from metallic material such as steel. Cap member 9 has top and bottom edge portions which are bent by rolling, crimping or other suitable means to the hold base member 1 and the sensor assembly together. An elastomeric o-ring 61 is positioned between the outer periphery of sensor assembly 60 and base member 1 and is deformed during the crimping/rolling operation to provide a tight attachment of the two items together.

A more detailed description of the fluid pressure responsive electric switch can be found in U.S. Pat. No. 5,808,255 which is incorporated herein by reference.

Sensor assembly 60 includes a top disc housing member 6, a composite actuator member 62 (used as a diaphragm) comprising a plurality of stacked disc members, and a lower housing support member 12. Lower housing support member 12 is a disc shaped member with a central aperture and is positioned directly adjacent first open end 42 of base member 1 and pin guide member 2. The composite actuator member 62 is formed of individual, snap-acting disc members of the same general diameter placed one on top of another (the number selected being dependent on the pressure levels to be monitored), sandwiched between top disc housing member 6 and lower housing support member 12. The top disc housing member and the lower housing support member are also the same general diameter as the composite actuator member 62.

The top disc housing member 6, composite actuator member 62 and lower housing support member 12 are joined together preferably by welding into a hermetic sensor assembly 60. The welding is done along the outer periphery of the components. It is preferable to use a multiple pass operation and to choose welding parameters to minimize localized annealing effects of the composite actuator member.

In accordance with this invention, the composite actuator 62 is not made from the same homogenous material in the snap acting disc members as is done in the prior art. Composite actuator 62 includes at least one disc member 17 of a chosen low coefficient of thermal expansion (CTE) material and at least one disc member 18 of a chosen standard high coefficient of thermal expansion (CTE) material. In another preferred embodiment of this invention, composite actuator member 62 additionally includes at least one membrane layer disc 19 positioned between the at least one high CTE material disc(s) 17 and the at least one low CTE material disc(s) 18.

Top disc housing member 6 has a slightly domed portion 7 with a large central aperture therethrough. The domed portion 7 is hermetically attached as by brazing and/or welding to a suitable fitting 8 with central opening to form the inlet passageway and pressure cavity 11 for the fluid to be measured by switch 10. The configuration of fitting 8 is selected in view of the application in which switch 10 is to be used. The top disc housing member is preferably made of a stainless steel material such as 17-4 precipitation hardening (PH) stainless steel. Other stainless steel materials such as 15-5 PH stainless steel, 302 stainless steel, 304 stainless steel, 316 stainless steel and 430 stainless steel could also be used.

Housing support member 12 has a central aperture for slidably receiving a transfer pin 14 which extends from the bottom of composite actuator member 62 through pin guide member 2 to the top of movable contact arm 72 to cause the movable contact arm to move in response to the movement of composite actuator member 62. Lower housing support member 12 is made by way of example from 430 stainless steel in the fully annealed state. Other stainless steel materials such as described above for top disc housing 6 could also be used.

In accordance with this invention, the snap-acting low CTE discs 17 are made of a material such as 455 stainless steel material formed with a domed-shaped central area. A typical thickness and diameter would be 0.0054 inches and 0.800 inches, respectively. The standard CTE for the 455 stainless steel material or other low CTE disc material used (for example, 410 stainless steel, 420 stainless steel, 430 stainless steel and 17-4 stainless steel) would be typically in the range of 10.0 to $11.0\times10^{-6}/°$ C.

In accordance with this invention, the snap-acting high CTE discs 18 are of a material such as 302 stainless steel material formed with a domed-shaped central area. A typical thickness and diameter would be 0.008 inches and 0.800 inches, respectively. The thickness for discs 17 and 18 may be increased or decreased to add or remove the number of individual pressure discs to meet a desired switch pressure range. The standard CTE for the 302 stainless steel material or other high CTE disc material used (for example, 17-4 stainless steel, 316 stainless steel, 321 stainless steel, 301 stainless steel and 304 stainless steel) would be typically in the range of 15.0 to $17.4\times10^{-6}/°$ C.

Membrane 19 is a thin, soft flat disc made from 321 stainless steel in the soft annealed state or other material such as brass, 316 stainless steel, aluminum, etc. The use of membrane 19 allows for more uniform distribution of forces within the composite actuator member 62 while dissipating friction and other dynamic forces which would otherwise be degrading to the device and causing drift with temperature in its switch points.

FIG. 4, by way of example, shows the sensor assembly 60 of the present invention after welding which includes the lower housing support member 12, eleven low CTE discs 17, membrane member 19, two high CTE discs 18 and upper disc support member 6. In tests, fluid pressure switches using such a sensor assembly 60 have shown much more consistent switch point readings over a wide range of temperatures.

FIG. 5 shows a comparison of average deviation in actuation pressure of a pressure switch using the composite sensor assembly of the first embodiment of the present invention and of a pressure switch using the homogeneous sensor assembly of the prior art. As can be seen in FIG. 5, the prior art device exhibits significant pressure point changes whereas the device of the present invention shows minor change with temperature.

Figure 2:
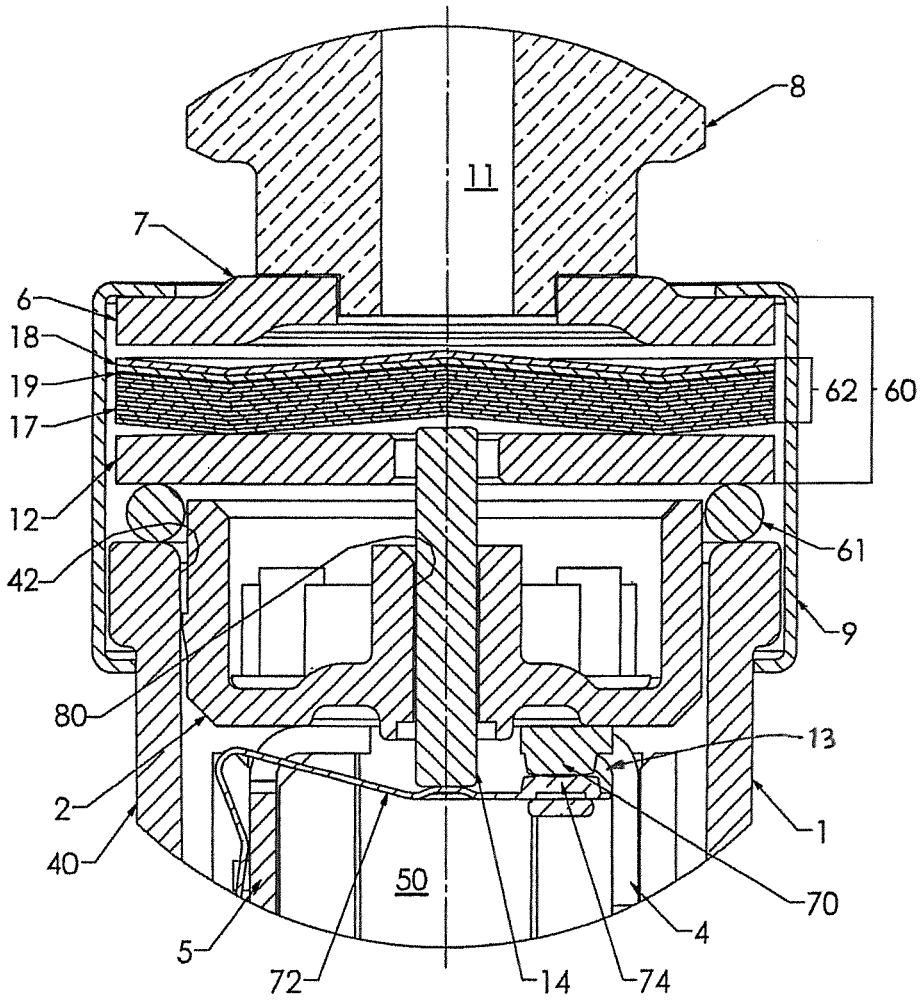
FIG. 2 is an enlarged cross sectional view of the section view B as shown in FIG. 1.
Figure 6:
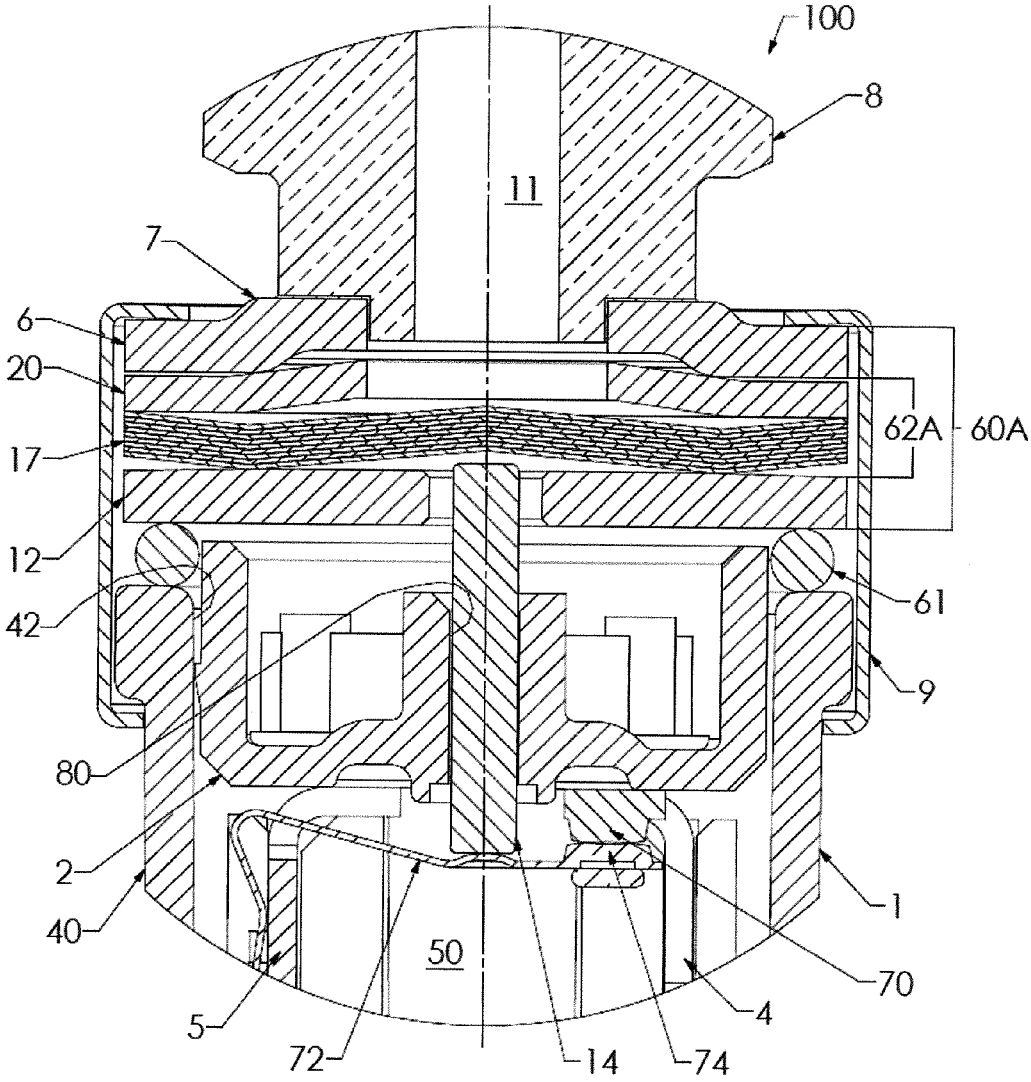
FIG. 6 is an enlarged cross sectional view similar to FIG. 2 showing a second embodiment of the present invention having a modified composite actuator member.

FIG. 6 shows an enlarged cross-sectional view of another embodiment of the present invention similar to FIG. 2 shown in the first embodiment of the present invention. This fluid pressure responsive switch 100 according to this embodiment has basically the same configuration as earlier described embodiments of fluid pressure responsive switch 10 described in FIGS. 1-5; however, switch 100 includes a sensor assembly 60A that is newly designed.

Sensor assembly 60A of this embodiment includes an additional thermal adjustment member 20 of a material of chosen low CTE material which is a stabilizing part of the actuator design. It is typically used in the actuator design instead of using snap-acting disc members of both high and low CTE in the actuator design. It is to be understood that the adjustment member could also be used with snap disc member of both high and low CTE as described above. In this embodiment, the thermal adjustment member would be used to provide the fluid pressure responsive electric switch with precise pressure set points over a wide temperature range.

As shown in FIG. 6, thermal adjustment member 20 is positioned directly adjacent to the plurality of disc members between top disc housing member 6 and plurality of disc members forming a new composite actuator member 62A. It could also be positioned between lower housing support member 12 and the plurality of disc members.

Thermal adjustment member 20 would have the same general diameter as top disc housing member 6, lower housing support member 12 and the plurality of snap-acting disc members, with a central aperture. The thickness would typically range between 0.025 inches and 0.065 inches. The thermal adjustment member would be joined together with the plurality of snap-acting disc members to form the composite actuator member along with the top disc housing member 6 and lower housing support member 12 preferably by welding into sensor assembly 60A as discussed earlier.

In according with this embodiment, thermal adjustment member is made from a material having a low CTE such as 455, 410, 420, or 17-4 stainless steel. These stainless steels have a CTE in the range of 10.0 to $11.0\times10^{-6}/°$ C.

The adjustment member as part of the composite actuator member of this embodiment is used when the sensor assembly results in less than adequate thermal drift properties for the fluid pressure sensor device 100. The addition of the low CTE material thermal adjustment member will both balance the mechanical stability and thermal stability of the sensor assembly 60A over the operational range of the fluid pressure sensor device 100.

In view of the above, it will be seen that the several objects of the invention are achieved and other advantageous results attained.

As many changes could be made in the above constructions and methods without departing from the scope of the invention, it is intended that all matter contained in the above description or shown in the accompanying drawings shall be interpreted as illustrative and not in a limiting sensor. It is also intended that the appended claims shall cover all such equivalent variations as come within the spirit and scope of the invention such as any applicable condition responsive electric switch.

What is claimed:

1. A fluid pressure responsive electric switch comprising:

an elongated generally tubular base member having a longitudinal axis and having a sidewall extending between a first and a second end;

a motion transfer guide member having a central bore mounted at the first end of the base member;

a fluid pressure responsive sensor assembly, comprising a composite actuator member sandwiched between a disc housing member with a central aperture and a housing support member with a central aperture, the disc housing member, housing support member, and the composite actuator member all having outer circular peripheral portions being welded together and being generally in alignment with the guide member, the sensor assembly and the base member being joined together; and an electric switch disposed within the base member and a motion transfer pin slidably mounted in the guide member and extending through the aperture in the housing support member between the composite actuator member and the electric switch, said composite actuator member comprising at least one member of a chosen low coefficient of thermal expansion (CTE) material and at least one member of a chosen high coefficient of thermal expansion (CTE) material.

2. A fluid pressure responsive electric switch according to claim 1 wherein said composite actuator member comprises at least one snap-acting disc member of a low CTE material and at least one snap-acting disc member of a high CTE material.

3. A fluid pressure responsive electric switch according to claim 2 further comprising a membrane positioned between the at least one high CTE material snap-acting disc member and the at least one low CTE material snap-acting disc member.

4. A fluid pressure responsive switch according to claim 1 wherein the high CTE material is in the range of 15.0 to 17.4.times.10.sup.−6/.degree. C. and the low CTE material is in the range of 10.0 to 11.0.times.10.sup.−6/.degree. C.

5. A fluid pressure responsive electric switch of claim 1 wherein the weld of the fluid pressure responsive pressure assembly is done in a multi-pass operation to minimize localized annealing effects of the composite actuator member.

6. A fluid pressure responsive electric switch according to claim 1 wherein said composite actuator member comprises a plurality of snap-acting disc members and a thermal adjustment member of a chosen low CTE material.

7. A fluid pressure responsive electric switch according to claim 6 wherein said plurality of snap-acting disc members are made from a material having a high CTE.

8. A fluid pressure responsive electric switch according to claim 6 wherein said plurality of snap-acting disc members comprises at least one snap-acting disc member of a chosen low CTE material and at least one snap-acting disc member of a chosen high CTE material.

9. A fluid pressure electric switch according to claim 7 wherein the high CTE material is in the range of 15.0 to 17.4.times.10.sup.−6/.degree. C. and the low CTE material is in the range of 10.0 to 11.0.times.10.sup.−6/.degree. C.

10. A fluid pressure responsive electric switch comprising:

an elongated generally tubular base member having a longitudinal axis and having a sidewall extending between a first and a second end;

a motion transfer guide member having a central bore mounted at the first end of the base member;

a fluid pressure responsive sensor assembly, comprising a composite actuator member sandwiched between a disc housing member with a central aperture and a housing support member with a central aperture, the disc housing member, housing support member, and the composite actuator member all having outer circular peripheral portions being welded together and being generally in alignment with the guide member, the sensor assembly and the base member being joined together; and an electric switch disposed within the base member and a motion transfer pin slidably mounted in the guide member and extending through the aperture in the housing support member between the composite actuator member and the electric switch, said composite actuator member comprising at least one member of a chosen low coefficient of thermal expansion (CTE) material and at least one member of a chosen high coefficient of thermal expansion (CTE) material;

wherein the composite actuator member comprises at least one snap-acting disc member of a low CTE material and at least one snap-acting disc member of a high CTE material and a membrane positioned between the at least one high CTE material snap-acting disc member and the at least one low CTE material snap-acting disc member.

11. A fluid pressure responsive switch according to claim 10 wherein the high CTE material is in the range of 15.0 to 17.4.times.10.sup.−6/.degree. C. and the low CTE material is in the range of 10.0 to 11.0.times.10.sup.−6/.degree. C.

12. A fluid pressure responsive electric switch of claim 10 wherein the weld of the fluid pressure responsive pressure assembly is done in a multi-pass operation to minimize localized annealing effects of the composite actuator member.

13. A fluid pressure responsive electric switch according to claim 10 wherein said composite actuator member comprises a plurality of snap-acting disc members and a thermal adjustment member of a chosen low CTE material.

14. A fluid pressure responsive electric switch according to claim 13 wherein said plurality of snap-acting disc members are made from a material having a high CTE.

15. A fluid pressure responsive electric switch according to claim 13 wherein said plurality of snap-acting disc members comprises at least one snap-acting disc member of a chosen low CTE material and at least one snap-acting disc member of a chosen high CTE material.

16. A fluid pressure electric switch according to claim 14 wherein the high CTE material is in the range of 15.0 to 17.4.times.10.sup.−6/.degree. C. and the low CTE material is in the range of 10.0 to 11.0.times.10.sup.−6/.degree. C.

* * * * *